US006416299B1

(12) United States Patent
Patrick et al.

(10) Patent No.: US 6,416,299 B1
(45) Date of Patent: Jul. 9, 2002

(54) MOTORCYCLE OIL PUMP

(76) Inventors: Bryon A. Patrick, 4491 E. Nye La., Carson City, NV (US) 89706; Cole Fife, 3905 Cypress St., Silver Springs, NV (US) 89429

( * ) Notice: Subject to any disclaimer, the term of this patent is extended or adjusted under 35 U.S.C. 154(b) by 0 days.

(21) Appl. No.: 09/545,544

(22) Filed: Apr. 7, 2000

(51) Int. Cl.[7] ..... F04B 49/00
(52) U.S. Cl. ..... 417/297; 123/54.4
(58) Field of Search ..... 123/73 D, 196 S, 123/179.25, 572, 54.4, 559.1, 196 R; 60/464, 327; 417/253, 297

(56) References Cited

U.S. PATENT DOCUMENTS 3,926,157 A * 12/1975 Lippitsch ..... 123/73 D
4,332,134 A * 6/1982 Cochran et al. ..... 60/464
4,347,044 A * 8/1982 Ahlen ..... 417/253
5,249,556 A * 10/1993 Emmitt ..... 123/196 S
5,495,833 A * 3/1996 Ishizaka et al. ..... 123/179.25
5,682,742 A * 11/1997 Sato et al. ..... 60/327
5,690,084 A * 11/1997 Gunjii et al. ..... 123/572
5,950,579 A * 9/1999 Ott ..... 123/54.4
6,105,558 A * 8/2000 Bushling ..... 123/559.1
6,116,205 A * 9/2000 Troxler et al. ..... 123/196 R

* cited by examiner

*Primary Examiner*—Teresa Walberg
*Assistant Examiner*—Leonid Fastovsky
(74) *Attorney, Agent, or Firm*—Brian C. Kelly JDLLM

(57) ABSTRACT

A motorcycle oil pump that provides a fixed shaft with high volume rotor gears and adjustable oil pressure.

4 Claims, 2 Drawing Sheets

MOTORCYCLE OIL PUMP

BACKGROUND-FIELD OF INVENTION

The invention relates generally to the field of motorcycle engines.

BACKGROUND OF INVENTION

Oil pump designs available in the state of the art for motorcycle engines are relatively arcane, low volume, and leaky. The primary problem is the limited space available for the various necessary systems. Applicants' invention provides a high volume oil pump in a motorcycle engine application.

SUMMARY & OBJECTS OF THE INVENTION

A first object of the invention is to provide a high volume oil pump for a Harley Davidson motorcycle engine.

A second object of the invention is to provide adjustable oil pressure.

DESCRIPTION OF PREFERRED EMBODIMENTS

Figure 1:
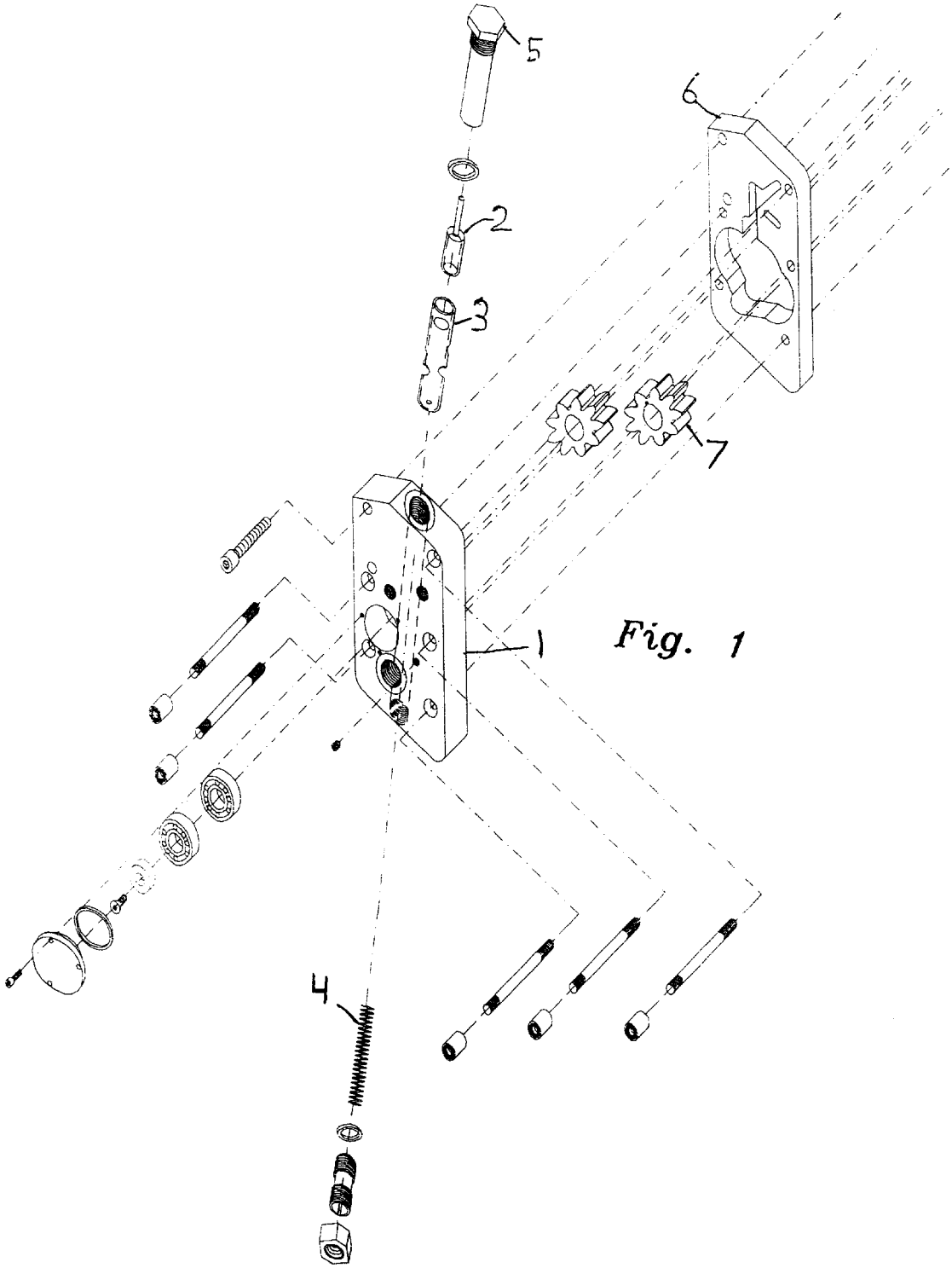
FIG. 1 is the pressure section.

FIG. 1 shows a pressure regulating back body 1 with a poppet valve 2 disposed in a sleeve 3 with a spring 4 to support the valve 2 and an adjustment screw 5 to adjust oil pressure by adjusting the valve 2. The pressure section gear housing body 6 holds two toothed gears 7 and attaches to the back body 1.

Figure 2:
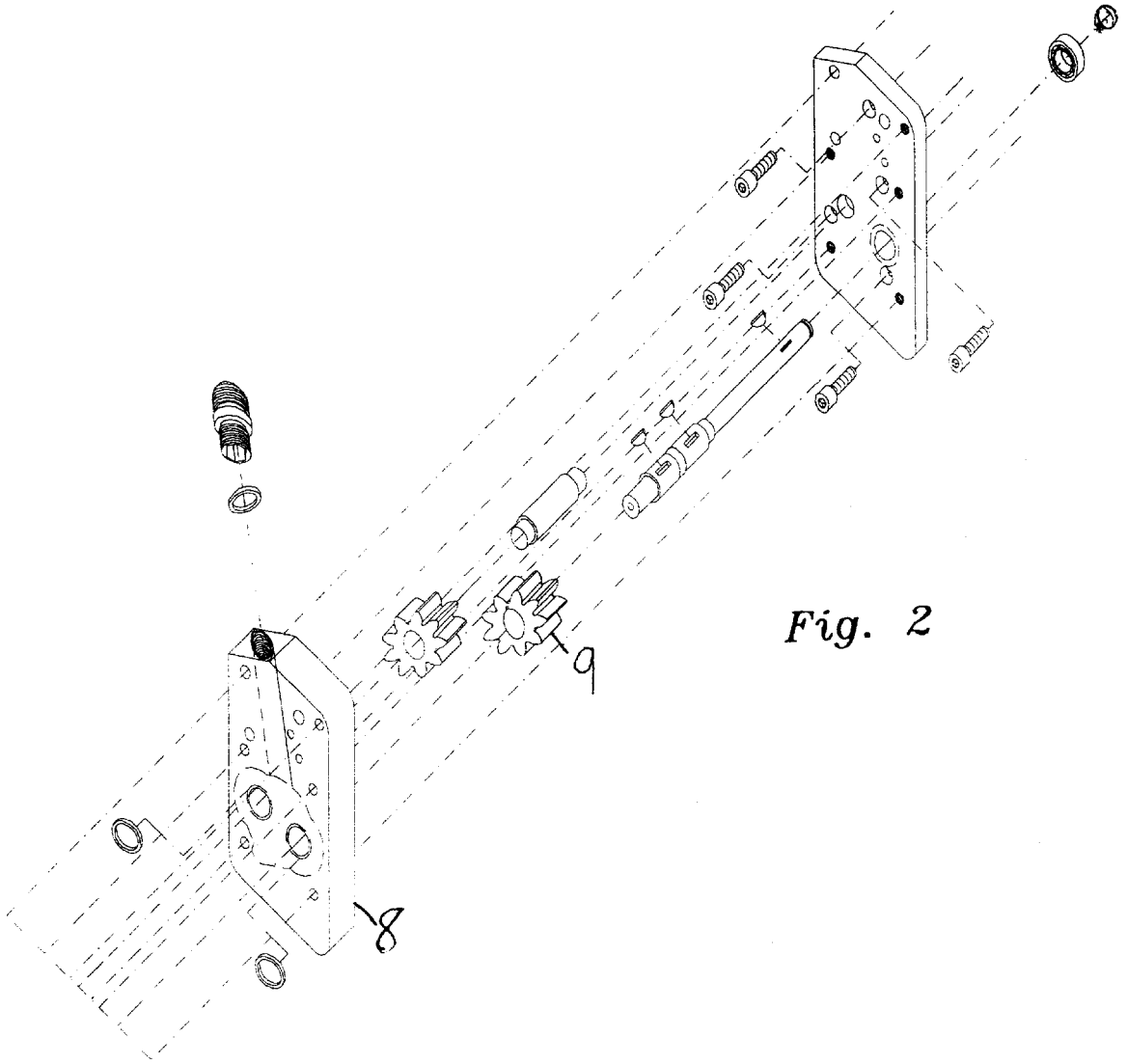
FIG. 2 is the scavenge section.

FIG. 2 shows the scavenge section of the pump, including a gear body housing 8 with two or more gears 9 and an outlet port to flow the oil to the pressure section of FIG. 1. The advantage of this invention is the increased oil volume available. The adjustability of the oil volume by operation of the adjustment screw 5 and the drive shaft is fixed for less pressure loss and leakage.

Obviously, numerous (additional) modifications and variations of the present invention are possible in light of the above teachings. It is, therefore, to be understood that within the scope of the appended Claims, the invention may be practiced otherwise than as specifically described herein.

What is claimed is:

1. A motorcycle oil pump apparatus comprising a fixed drive shaft and at least two gears and a poppet valve disposed within a sleeve of an aluminum plate body.

2. A motorcycle oil pump apparatus as described in claim 1 wherein said gears comprise 9 teeth.

3. A motorcycle oil pump apparatus as described in claim 1 wherein said poppet valve further comprises an adjustment screw to adjust oil pressure.

4. A motorcycle oil pump apparatus as described in claim 1 wherein said poppet valves sleeve comprises steel and said body comprises aluminum.

* * * * *